United States Patent [19]

Bialy et al.

[11] Patent Number: 4,977,982

[45] Date of Patent: Dec. 18, 1990

[54] ELEVATOR SHEAVE BRAKE SAFETY

[75] Inventors: Louis Bialy, Simsbury; Anthony Cooney, Farmington; William Sheridan, Southington; Edward Reiskin, West Hartford, all of Conn.

[73] Assignee: Otis Elevator Company, Farmington, Conn.

[21] Appl. No.: 456,416

[22] Filed: Dec. 26, 1989

[51] Int. Cl.[5] ..... B66B 5/16

[52] U.S. Cl. ..... 187/89; 187/108; 187/74; 188/180

[58] Field of Search ..... 187/89, 73, 90, 88, 187/109, 108, 30, 31, 74; 188/188, 186, 180

[56] References Cited

U.S. PATENT DOCUMENTS

| | | | |
|---|---|---|---|
| 3,469,678 | 9/1969 | Schroder et al. | 198/232 |
| 3,587,785 | 6/1971 | Krauer et al. | 187/29 R |
| 3,695,396 | 10/1972 | Jones | 187/89 |
| 4,095,681 | 6/1978 | David | 187/89 |
| 4,538,706 | 9/1985 | Koppensteiner | 187/90 |
| 4,923,055 | 5/1990 | Holland | 187/89 |

*Primary Examiner*—H. Grant Skaggs
*Assistant Examiner*—Kenneth Noland
*Attorney, Agent, or Firm*—Edward L. Kochey, Jr.

[57] ABSTRACT

The cable drive sheave (14) carries a wedge-shaped brake ring (44) engageable with V-shaped brake shoes (52, 58). Each shoe is spring biased (68, 76) tangentially toward the ring and resiliently supported and biased radially (50) toward the ring. The shoes are restrained (84) during normal elevator operation and released on either cab upward overspeed (22) or on cab movement from a landing with the doors open (32).

31 Claims, 6 Drawing Sheets

ELEVATOR SHEAVE BRAKE SAFETY

TECHNICAL FIELD

The invention relates to cable supported and counterweighted elevators and in particular to a safety brake therefor.

BACKGROUND

Elevators conventionally have a car and a counterweight with these being connected by cables passing over a support sheave. The counterweight is selected of a weight between the empty and fully loaded weight of the car. Normal braking is accomplished by controlling the drive motor speed and torque to bring the car to a complete stop at the floor. Once at the floor, power is removed from the drive motor and a spring loaded friction brake is used to hold the car at the floor.

A safety is located on the car frame which engages the guide rails on downward overspeed of the car. Such engagement of the rails is not desirable in the upward direction because of the possibility of stopping with a greater than 1-G deceleration if the safety jams.

It is also known to prevent energization of the drive motor when the doors are open and the car is greater than a preselected distance from a landing. Some discrete movement is desirable to permit leveling of the elevator car, provided that the car is within close proximity of the landing with the doors open.

It is also possible, however, to experience an upward overspeed of the car. For instance this can occur with malfunction of the brake or control system and a lightly loaded car. This is particularly a problem when the car is at a low elevation so that substantial speed can be obtained by the time the car reaches the overhead building structure.

Movement from the floor can possibly occur even with the drive motor deenergized. Therefore, it is desirable to have a safety braking action to stop movement of the car beyond a predetermined distance with the doors open.

Certain elevator code regulations are in progress requiring a safety on upward overspeed and also on movement up or down beyond a specified distance with the elevator doors open. These codes will normally require that the safety braking system be independent of the regular controls.

Tripping of the conventional rail safety causes damage to the guide rails requiring rework. It would be convenient to have a downward overspeed safety operable before the rail safety operates, with the alternate safety either requiring no rework, less rework than the conventional guiderail safety, or inexpensive replaceable parts in the event of damage.

SUMMARY OF THE INVENTION

The cable drive sheave has a brake ring comprising a pair of angularly disposed braking surfaces A first brake shoe has complimentary braking surfaces forming a V-groove and a wedge. A resilient support guides the first shoe in a direction substantially tangential to the sheave bearing surface. A first shoe engagement means biases the shoe toward engagement with the brake ring, and a stop is located to limit the travel of the first brake shoe when it is in contact with the sheave braking surfaces. The shoe is electrically held out of engagement.

A second brake shoe also has braking surfaces complimentary to the sheave braking surfaces. It has biasing means for urging it into contact with the ring and disablement means for holding it out of engagement with the ring. This also is held out of engagement electrically.

The sheave is rotating when the car is moving in the up direction, in a direction away from the first shoe. Overspeed means releases the first or both shoes on a detected overspeed in the upward direction. Both the first and second shoes are released into engagement when the car moves a discrete distance from a landing with the doors open.

DESCRIPTION OF THE PREFERRED EMBODIMENT

Figure 1:
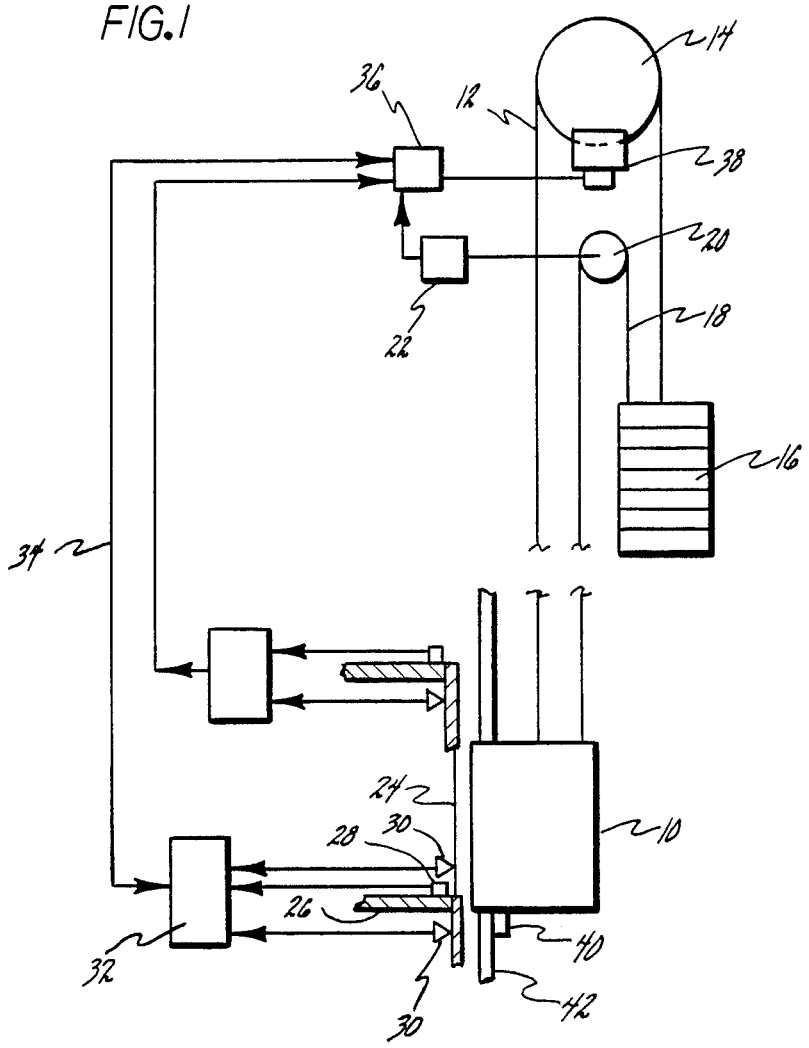
FIG. 1 is a schematic of the elevator system.

Car 10 is supported by cable 12 passing over sheave 14 and secured to counterweight 16. A secondary cable 18 passing over idler pulley 20 enables tachometer 22 or overspeed governor to determine the direction and rate of travel of the car.

Doors 24 at landing 26 include detection means 28 for detecting a door open condition. Level sensors 30 detect the location of the car with respect to the landing and cooperate with the door open sensor 28 in controller 32 to determine whether the car has moved beyond the preselected distances from the landing with the doors open. A control signal indicative of movement with the doors open is sent through control line 34 to sheave brake controller 36 which releases sheave brake 38.

A conventional safety 40 operates on rail 42 to stop car 10 on an overspeed downwardly.

Figure 2:
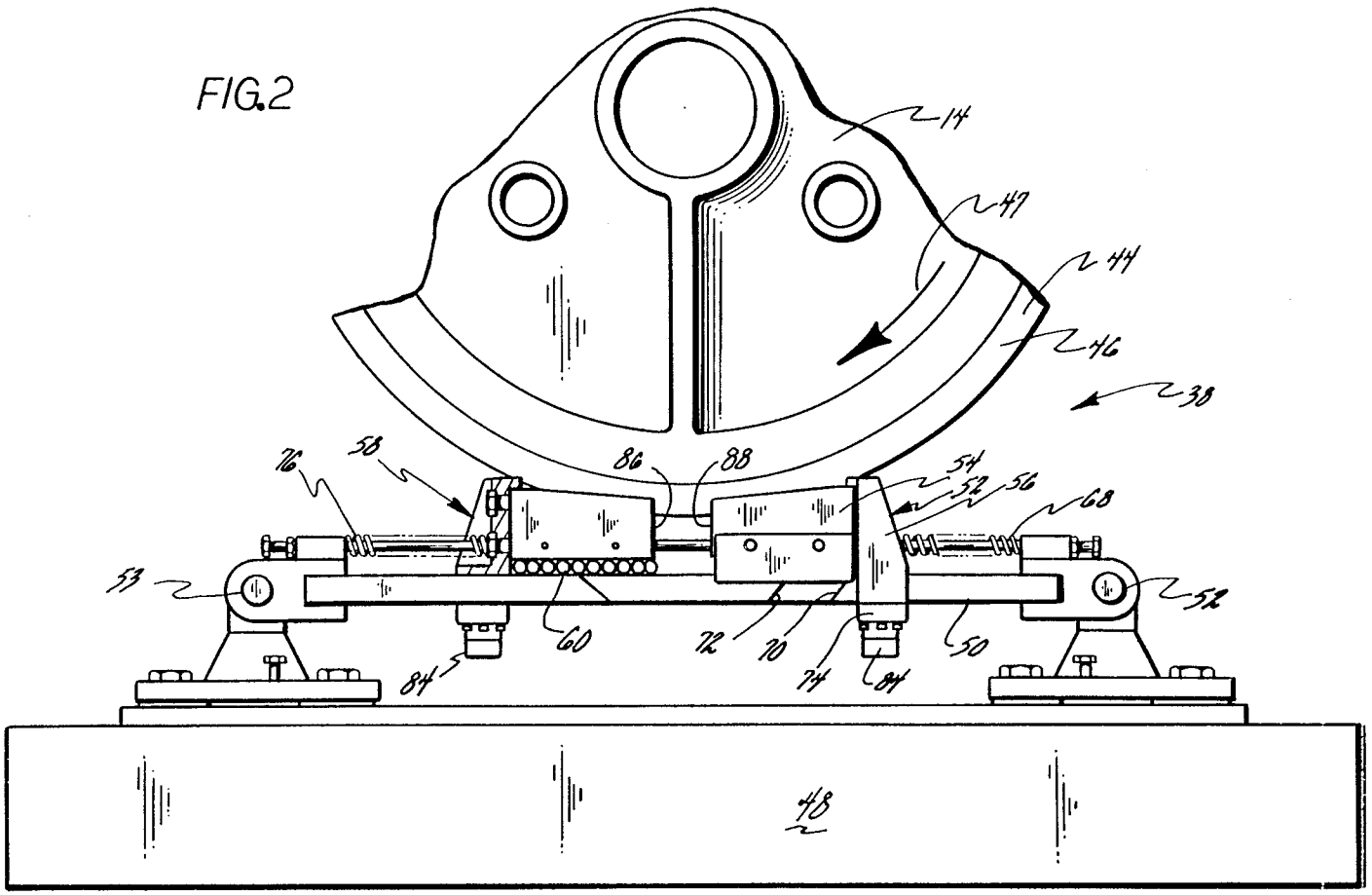
FIG. 2 is a side elevation partial section of the sheave brake in the nonbraking position without the solenoid being shown.
Figure 5:
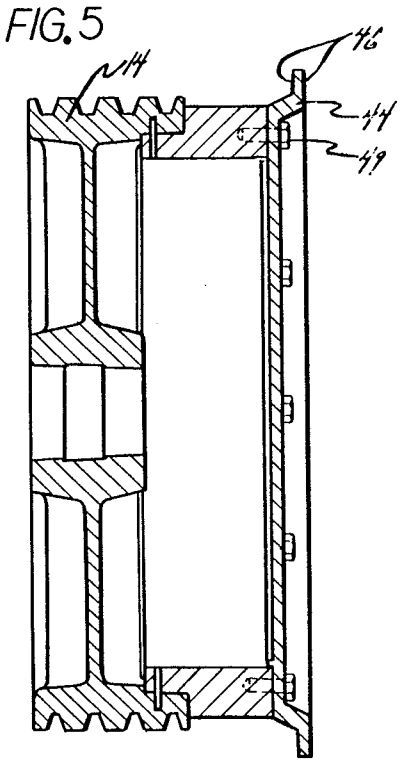
FIG. 5 is a view of the braking surface on the sheave.

FIG. 2 illustrates the sheave brake 38 with sheave 14 having a brake ring 44 secured thereto. It has angularly disposed wedge shape braking surfaces 46. The arrangement of the brake ring on the sheave is shown in FIG. 5 where brake ring 44 is secured to sheave 14 by bolts 49.

Secured to the building support structure 48 is an end supported resilient beam 50 pivotally supported at supports 52 and 53, respectively. Sheave 14 rotates in the direction 47 on upward motion of the car.

A first brake shoe 52 has a shoe portion 54 and a stop block portion 56. A second brake shoe 58 is similarly arranged. Each brake shoe is supported on beam 50 with roller bearing 60 therebetween to minimize friction between the brake shoes and the beam.

Figure 6:
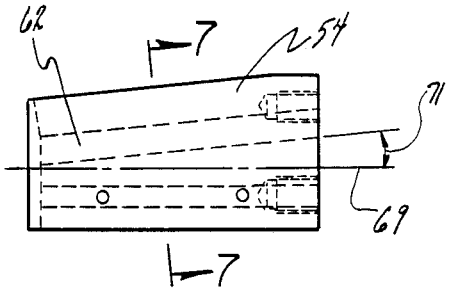
FIG. 6 is a side elevation of a shoe segment portion.
Figure 7:
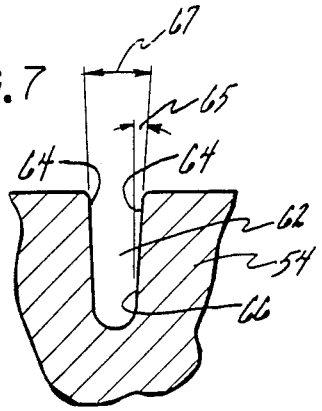
FIG. 7 is a view through section 7—7 of FIG. 6.

FIGS. 6 and 7 show the shoe segment 54 of the brake shoe in more detail. A groove 62 through the brake shoe has angularly disposed braking surfaces 64 which are complimentary to the angularly disposed braking surfaces on the sheave. These surfaces are located at an angle 65 of 4 degrees with respect to the vertical surface 66, and should be preferably with the included angle 67 between the surfaces 64 being between 4 degrees and 20 degrees.

With the 4 degree angle shown and therefore an included angle of 8 degrees, any radial force directing the brake shoe toward the sheave is multiplied by a factor of 14.3 in determining the face loading of the braking surfaces.

Groove 62 is disposed at an angle 71 of 5 degrees with respect to the shoe axis 69 and direction of travel. This should preferably be between 3 and 8 degrees. As illustrated, the groove 62 is linear in the direction along the axis. Providing some air to this groove would increase the contact surface when braking. It should, however, have a radius greater than that of the the sheave braking surface. Otherwise, the leading edge of the shoe could engage beyond the sheave centerline and tend to lift the shoe.

Returning to FIG. 2, spring 68 biases the first brake shoe 52 to the left in a direction with the first shoe braking surface 64 moving tangential to the sheave braking surface 46. Accordingly, with the sheave moving in the direction indicated by arrow 47, the shoe is urged into braking surface contact generating a force tending to stop the sheave. The shoe is also drawn to the left until stop 70 on the brake shoe contacts stop 72 on the support 50.

The resilient support 50 and the support locations 53 are selected and adjusted so that the deflection of the beam with the brake shoe at the stop provides the desired loading against the braking surfaces. Sufficient range of deflection should be selected to provide appropriate force even after some wear of the braking surfaces.

It is noted that the horizontal force to the left toward the upper portion of the brake shoe in combination with the resistance to movement against stop 70 provides an overturning moment that would tend to rotate the brake shoe. Accordingly, stop surfaces 72 and 70 are canted whereby they generate a radial force component with respect to the sheave sufficient to resist the overturning moment.

Figure 3:
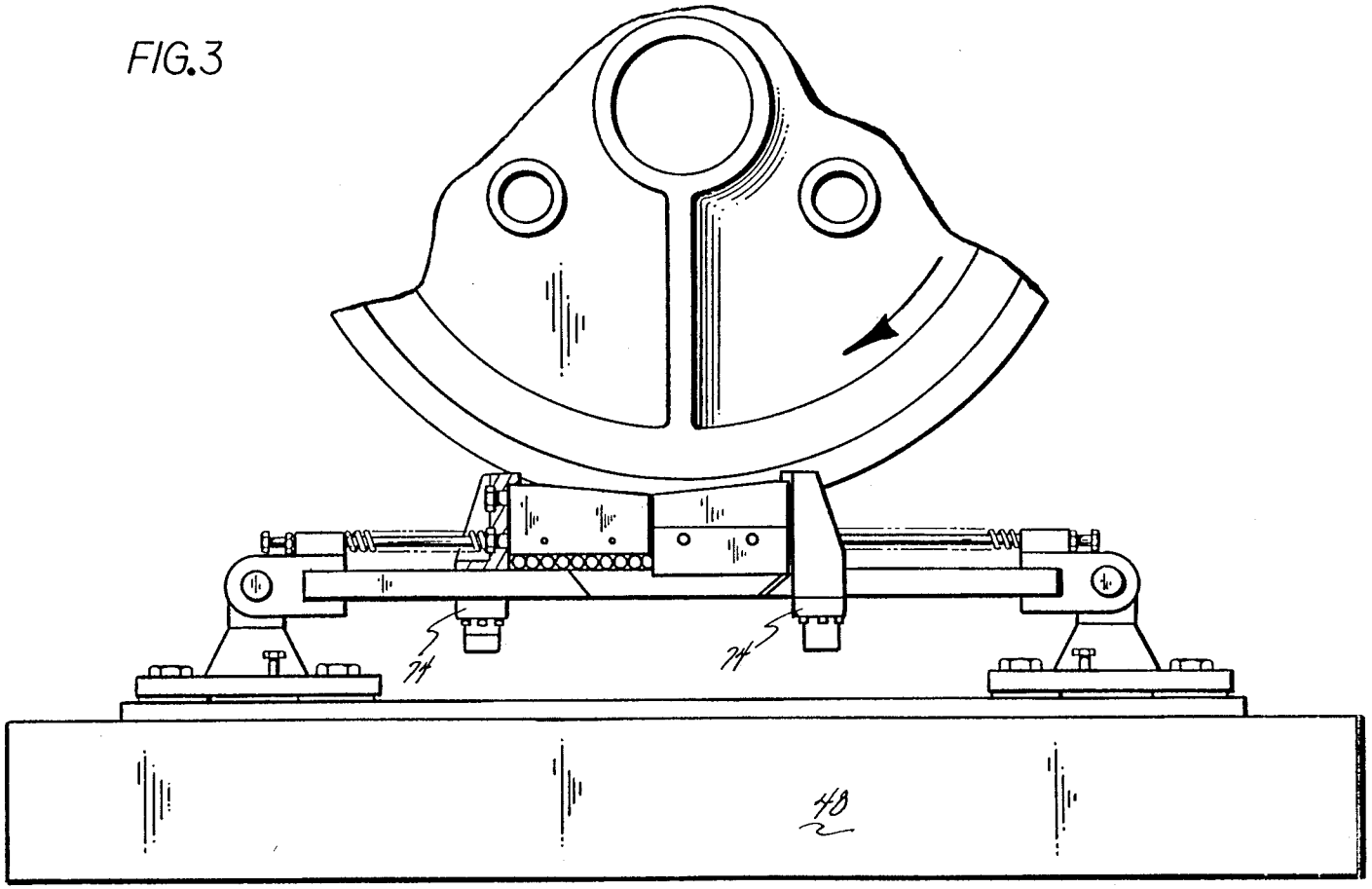
FIG. 3 is a side elevation of the sheave brake in the braking position.

FIG. 3 illustrates the shoe in the engaged position with the stops in contact. After the shoe has operated to this position to brake the sheave, it may be wedged relatively tightly to the sheave. On reverse rotation of the sheave the shoe would tend to follow the sheave and be lifted from the support. Strap 74 engages the bottom side of the support beam to facilitate pulling the shoe loose from the sheave.

The second brake shoe 58 is similarly disposed with spring 76 urging the shoe into engagement.

Figure 4:
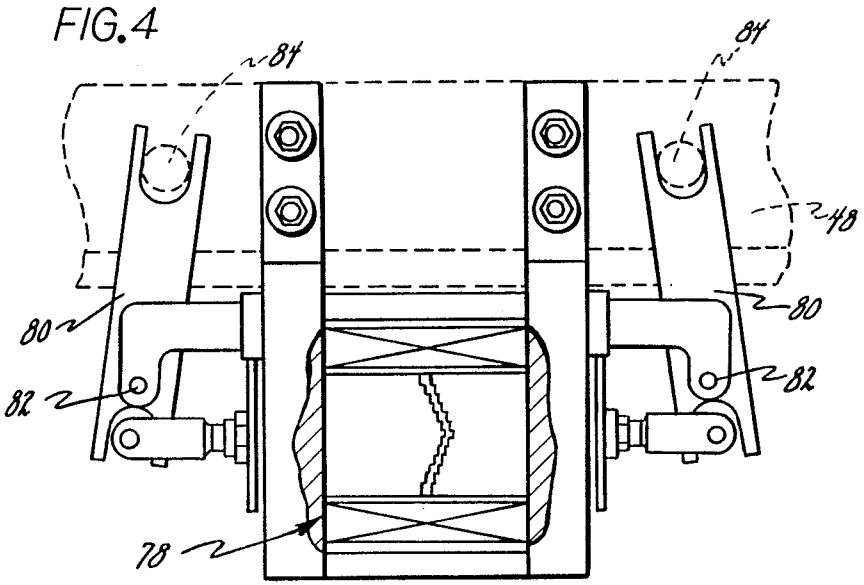
FIG. 4 is a view of the solenoid drive.

Referring to FIG. 4, also secured to support structure 48 is solenoid assembly 78. When energized, levers 80 operate around pivot 82 to withdraw pins 84 secured to the braking shoes, thereby retaining the braking shoes out of engagement with the sheave. It is noted that even when released to the position illustrated the arms 80 do not come out of engagement with pins 84, so that the solenoid may be energized to withdraw the brake shoes without manual disengagement. It is recognized, however, that after a hard stop the reverse movement of the sheave may be required to accomplish the disengagement.

Figure 8:
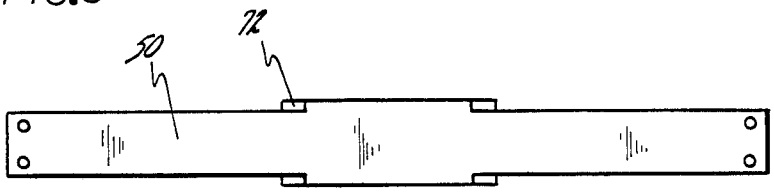
FIG. 8 is a view of the shoe support beam.

FIG. 8 illustrates the location of stops 72 on support beam 50. Referring again to FIGS. 2 and 3, the first shoe 52 and the second shoe 58 are sized such that mutual abutment surfaces 86 and 88 preclude simultaneous contact of the two shoes with the sheave at the same time.

When overspeed of the car is detected in the upward direction by speed detecting means 22 (FIG. 1), the solenoid 78 (FIG. 4) is deenergized to release brake shoe 52 (FIG. 2). The spring 68 forces the brake shoe into engagement with the sheave braking surface. This is brought into contact with the surface tangentially so that no sudden impact loading is applied to the surface. This avoids excessive and dangerous stopping rates of the elevator. The load is quickly but uniformly applied as the shoe moves along the surface, with the loading being applied by the resilient support 50.

Whether brake shoe 58 is also released this time is irrelevant since it will not be operable because of the direction of rotation of the sheave.

When discrete movement of the elevator from a landing is detected beyond a preselected distance, both solenoids are deenergized with both brake shoes moving toward contact with the sheave. Since the support is in its undeflected state, even with the mutual abutment surfaces one of the shoes will contact the brake surface. If it happens to be the shoe moving against the direction of rotation it will be pushed back and the other shoe will come into engagement. In any event the appropriate shoe will engage the sheave to stop uncontrolled movement of the car. The force will be increased as required by deflection of the beam caused by the shoe being pulled in toward the centerline. Roller bearings 60 provide increased assurance of the proper movement by minimizing frictional resistance against the beam.

Conventional safety 4 (FIG. 1) operating against rails 42 will always be in service and activated for use. Since, however, this may cause damage to the rails, it may be preferable at times to set the sheave braking system to trip even on a downward direction at a velocity less than that of the trip of safety 40. In this case shoe 58 will provide the braking forces required.

The loading of these braking surfaces are selected to provide a typical deceleration between 0.1 and 0.7G for the elevator car. It is noted that should for some reason the braking surfaces grab, and tend to overdecelerate the car beyond 1 G, the upward moving component (counterweight or car) will slack the cable and the cable will slip around the sheave. Thus operation of the brake on the sheave itself provides a safe regulated stopping force which is operable even in the event of a shaft breakage of the drive mechanism.

Figure 9:
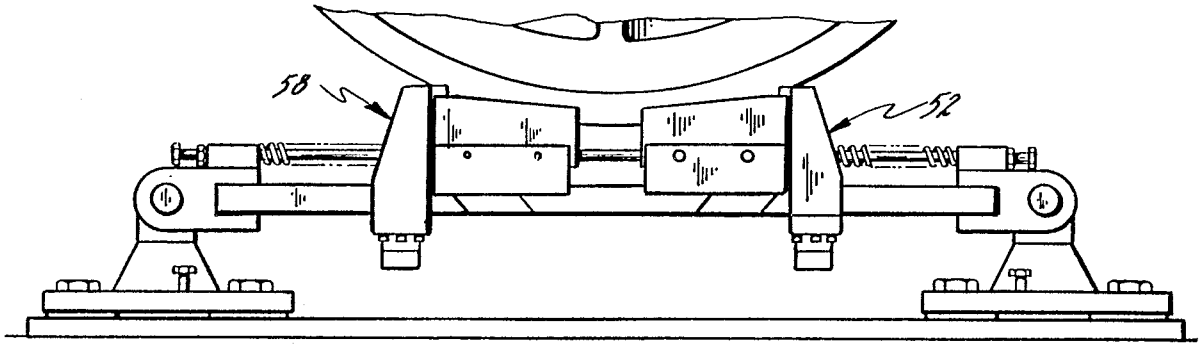
FIG. 9 is a side elevation of an alternate embodiment with two brake shoes being integral.

FIG. 9 illustrates an alternate embodiment wherein brake shoe 52 and brake shoe 58 are joined as an integral brake shoe 90. Such an integral brake shoe must be designed with a braking surfaces in contact with the sheave with the spring in the undeflected position. The shoe will then operate in either direction substantially in the manner described before.

We claim:

1. In an elevator system having a cable supported car, a cable supported counterweight, a cable drive sheave, and a cable connecting said car and said counterweight and passing over said sheave, a safety braking system comprising:

a brake ring on said sheave having a sheave braking surface comprising a pair of angularly disposed braking surfaces;

a first brake shoe having a first brake shoe braking surface comprised of a pair of angularly disposed braking surfaces;

one of said pair of angularly disposed braking surfaces being a V groove and the other being a wedge, each having substantially same included angle between the pair of braking surfaces;

a support for supporting and guiding said first shoe in a direction with said first shoe bearing surface moving tangential to the sheave bearing surface;

a first shoe load radial biasing means for resiliently biasing said shoe in said support substantially radially toward said brake ring;

a first shoe engagement biasing means for urging said shoe tangentially into engagement with said brake ring;

a first stop on said support for limiting travel of said first brake shoe at a location where said shoe braking surfaces and said sheave braking surfaces are in contact;

first shoe disengaging means for holding said first brake shoe against said first shoe engagement biasing means out of engagement with said brake ring;

a second brake shoe having a pair of second shoe braking surfaces complimentary to the pair of sheave braking surfaces;

second shoe biasing means for urging said second shoe into contact with said brake ring;

second shoe disablement means for holding said second shoe out of engagement with said brake ring;

said sheave rotating in a direction away from said first shoe when said car is moving in the up direction;

overspeed means for releasing said disengaging means on a detected overspeed in the upward direction; and locking means for releasing both said first shoe disengaging means and said second shoe disablement means on discrete movement of said car from a landing with the doors open.

2. A safety braking system as in claim 1:

a support abutment surface on said support;

a shoe abutment surface on said first shoe; and said support abutment surface and said shoe abutment surface in contact when said shoe is in said contact with said braking surface, said abutting surfaces having a radial force component with respect to said sheave, whereby the overturning moment caused by the force of said braking surface is resisted.

3. A safety braking system as in claim 1:

the included angle between said angularly disposed braking surface being between 4 degrees and 20 degrees.

4. A safety braking system as in claim 3:

said shoe braking surface substantially along the axis of said brake shoe being linear at an angle between 4 degrees and 8 degrees with respect to the direction of travel.

5. A safety braking system as in claim 4:

a roller bearing located between said first shoe and said support, whereby frictional resistance to tangential movement is minimized; and a strap secured to said first shoe, engageable with the under side of said support, whereby said shoe is withdrawn from contact from said sheave braking system on reverse rotation of said sheave.

6. A safety braking system as in claim 5:

said first shoe disengaging means and said second shoe disablement means comprising:

a solenoid;

a linkage connecting said solenoid and each of said brake shoes;

said shoes maintained out of engagement when said solenoid is energized; and said linkage remaining in engagement with said shoes when said solenoid is deenergized.

7. A safety braking system as in claim 1:

said support comprising an end supported beam; and said stop located to stop the tangential travel of said first shoe at a location intermediate the supports of said beam.

8. A safety braking system as in claim 1:

the arc of said brake shoe braking surfaces substantially along the axis of said brake shoe having a radius greater than the radius of said braking surface.

9. A safety braking system as in claim 8:

said brake shoe braking surface being linear in the direction substantially along the axis of said brake shoe.

10. A safety braking system as in claim 9:

said shoe braking surface at an angle between 4 degrees and 8 degrees with respect to the direction of travel.

11. A safety braking system as in claim 1:

a roller bearing located between said first shoe and said support, whereby frictional resistance to tangential movement is minimized.

12. A safety braking system as in claim 1:

a strap secured to said first shoe, engageable with the under side of said support, whereby said shoe is withdrawn from contact from said sheave braking system on reverse rotation of said sheave.

13. A safety braking system as in claim 1, said first brake shoe comprising:

a stop block portion;

a shoe segment bolted to said stop lock portion; and said stop located on said stop lock portion.

14. A safety braking system as in claim 1:

said first shoe disengaging means and said second shoe disablement means comprising:

a solenoid;

a linkage connecting said solenoid and each of said brake shoes;

said shoes maintained out of engagement when said solenoid is energized; and said linkage remaining in engagement with said shoes when said solenoid is deenergized.

15. A safety braking system as in claim 1:

said second shoe biasing means comprising, a second shoe radially biasing means for resiliently biasing said second shoe in said support substantially radially towards said brake ring and a second shoe engagement biasing means for urging said second shoe tangentially into engagement with said brake ring;

a second shoe stop for restraining movement of said second shoe when said second shoe and said brake ring are in contact; and said second shoe disablement means comprising, second shoe disengaging means for holding said brake shoe against said second shoe biasing means out of engagement with said brake ring.

16. A safety braking system as in claim 15:

said first shoe and said second shoe each having a mutual abutment surface located to preclude both shoes being in contact with said sheave breaking surface at the same time.

17. A safety braking system as in claim 15:
said first and second brake shoes being formed as an integral member.

18. A safety braking system as in claim 15:
a rail safety braking system operative at a first speed in the downward direction; and
said second shoe disengaging means operative at a second speed in the downward direction less than said first speed.

19. A safety braking system as in claim 15:
said first shoe disengaging means and said second shoe disengaging means comprising:
a solenoid;
a linkage connecting said solenoid and each of said brake shoes;
said shoes maintained out of engagement when said solenoid is energized; and
said linkage remaining in engagement with said shoes when said solenoid is deenergized.

20. A safety braking system as in claim 15:
a support abutment surface on said support;
a shoe abutment surface on said each shoe; and
said support abutment surface and said shoe abutment surface in contact when said shoe is in said contact with said braking surface, said abutting surfaces having a radial force component with respect to said sheave, whereby the overturning moment caused by the force of said braking surface is resisted.

21. A safety braking system as in claim 15:
the included angle between said angularly disposed braking surfaces being between 4 degrees and 20 degrees.

22. A safety braking system as in claim 15:
said support comprising an end supported beam; and
said stop located to stop the tangential travel of said first shoe at a location intermediate the supports of said beam.

23. A safety braking system as in claim 15:
the arc of said brake shoe braking surfaces substantially along the axis of said brake shoe having a radius greater than the radius of said braking surface.

24. A safety braking system as in claim 23:
said brake shoe braking surface being linear in the direction substantially along the axis of said brake shoe.

25. A safety braking system as in claim 24:
said shoe braking surface at an angle between 4 degrees and 8 degrees with respect to the direction of travel.

26. A safety braking system as in claim 15:
a roller bearing located between each shoe and said support, whereby frictional resistance to tangential movement is minimized.

27. A safety braking system as in claim 15:
a strap secured to each shoe, engageable with the under side of said support, whereby either shoe is withdrawn from contact from said sheave braking system on reverse rotation of said sheave.

28. A safety braking system as in claim 15:
said shoe braking surface substantially along the axis of said brake shoe being linear at an angle between 4 degrees and 8 degrees with respect to the direction of travel.

29. A safety braking system as in claim 28:
a roller bearing located between each shoe and said support, whereby frictional resistance to tangential movement is minimized; and
a strap secured to each shoe, engageable with the under side of said support, whereby either shoe is withdrawn from contact from said sheave braking system on reverse rotation of said sheeve.

30. A safety braking system as in claim 29:
said first shoe disengaging means and said second shoe disengaging means comprising:
a solenoid;
a linkage connecting said solenoid and each of said brake shoes;
said shoes maintained out of engagement when said solenoid is energized; and
said linkage remaining in engagement with said shoes when said solenoid is deenergized.

31. A safety braking system as in claim 30:
a rail safety braking system operative at a first speed in the downward direction; and
said second shoe disengaging means operative at a second speed in the downward direction less than said first speed.

* * * * *